US008468615B2

(12) United States Patent
Tremp

(10) Patent No.: US 8,468,615 B2
(45) Date of Patent: Jun. 25, 2013

(54) MOUNTING DEVICE FOR A SANITARY BODY

(75) Inventor: Reto Tremp, Benken (CH)

(73) Assignee: Geberit International AG, Jona (CH)

( * ) Notice: Subject to any disclaimer, the term of this patent is extended or adjusted under 35 U.S.C. 154(b) by 682 days.

(21) Appl. No.: 12/559,172

(22) Filed: Sep. 14, 2009

(65) Prior Publication Data

US 2010/0065699 A1 Mar. 18, 2010

(30) Foreign Application Priority Data

Sep. 17, 2008 (EP) ..... 08405228

(51) Int. Cl.
*E03D 11/00* (2006.01)
*E04B 2/82* (2006.01)
*A47B 17/04* (2006.01)

(52) U.S. Cl.
USPC ..... 4/252.2; 4/661; 4/353; 4/901; 52/126.1; 312/204

(58) Field of Classification Search
USPC ..... 4/252.2, 253, 353, 661, 901
See application file for complete search history.

(56) References Cited

U.S. PATENT DOCUMENTS

| | | | | |
|---|---|---|---|---|
| 5,913,612 | A * | 6/1999 | Turner | 4/353 |
| 6,035,589 | A * | 3/2000 | Schmucki et al. | 52/126.1 |
| 6,128,787 | A * | 10/2000 | Krist et al. | 4/300 |
| 2009/0144890 | A1 * | 6/2009 | Gierer et al. | 4/445 |

FOREIGN PATENT DOCUMENTS

| | | | |
|---|---|---|---|
| DE | 29507439 | U1 | 8/1995 |
| DE | 20002792 | U1 | 9/2000 |
| DE | 20307093 | U1 | 7/2003 |
| DE | 10207067 | A1 | 9/2003 |
| EP | 0867570 | A1 | 9/1998 |
| EP | 1245748 | A2 | 10/2002 |
| EP | 1854927 | A1 | 11/2007 |
| EP | 1916346 | A1 | 4/2008 |
| FR | 2883011 | A1 | 9/2006 |

* cited by examiner

*Primary Examiner* — Gregory Huson
*Assistant Examiner* — Christine Skubinna
(74) *Attorney, Agent, or Firm* — Sughrue Mion, PLLC

(57) ABSTRACT

The mounting device has a mounting frame (2) that includes means for securing the sanitary body. A covering (14, 15, 26) is positioned on the mounting frame (2), said covering concealing the mounting frame at least at the front. The covering (14, 15, 26) has at least one first decorative element (15) that conceals the mounting frame (2) at the front and is secured to the mounting frame (2) and at least one second decorative element (26) that conceals the mounting frame (2) at the top. The second decorative element (26) forms a removable cover for a cistern (5) mounted in the mounting frame (2). The covering (14, 15, 26) preferably has at least two further decorative elements (14) that conceal the mounting frame (2) at the sides.

11 Claims, 6 Drawing Sheets

MOUNTING DEVICE FOR A SANITARY BODY

Figure 1:
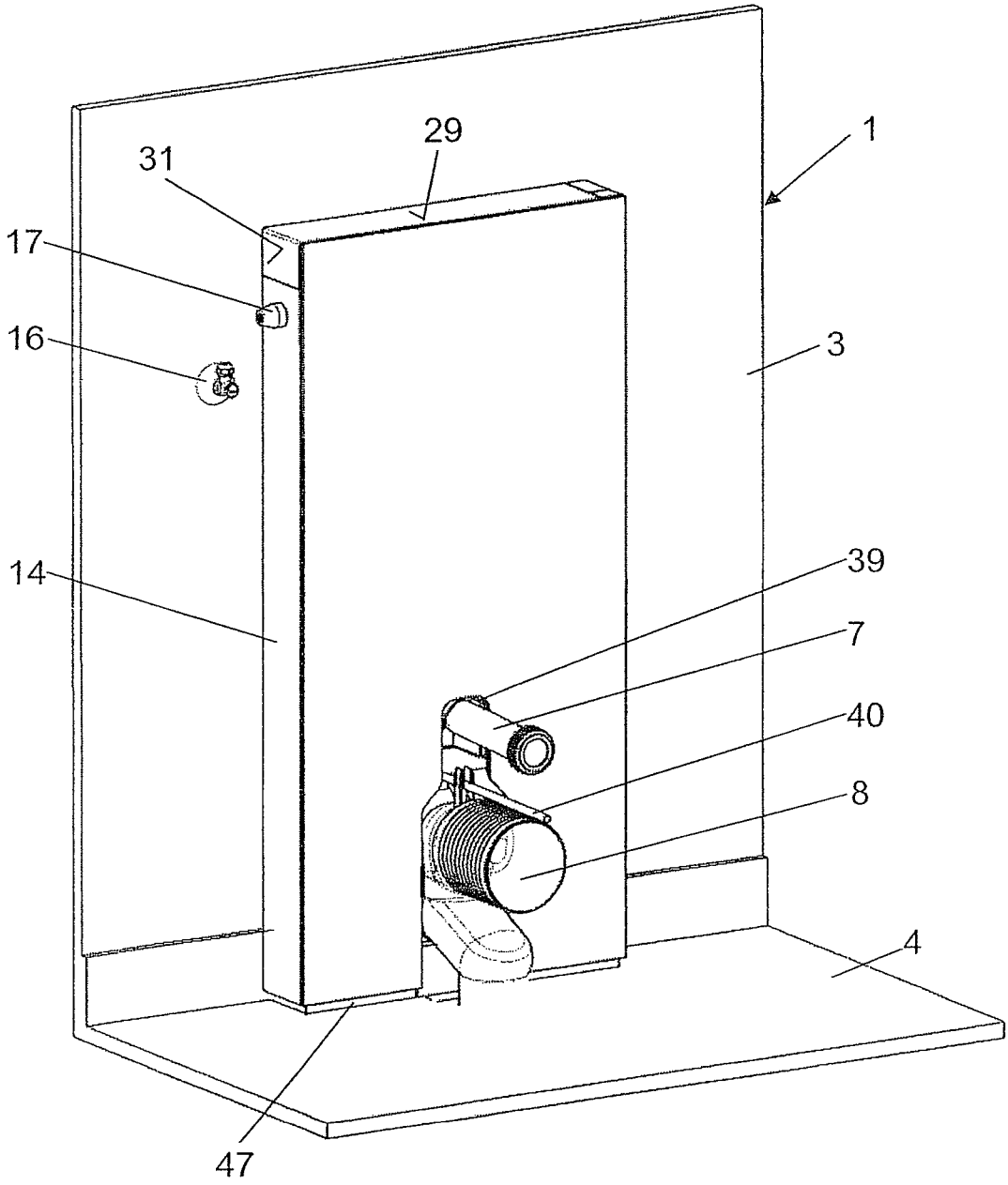

The invention relates to a mounting device for a sanitary body, said mounting device having a mounting frame that includes means for securing the sanitary body, a cistern mounted in the mounting frame and a covering that conceals the mounting frame at least at the front.

Mounting devices of this type have been known for a long time in particular for toilets and urinals. The mounting frame, as a rule, comprises two vertical struts and cross bars connecting said struts. The mounting frame and the cistern are concealed by a covering. Said covering, as a rule, is produced from gypsum plasterboard and tiling. Constructing such a covering is comparably expensive and time-consuming. If a repair becomes necessary, the tiling may have to be removed, which is correspondingly expensive and time-consuming.

To avoid the named disadvantages, DE 203 07 093 U proposes a front wall mounting system for bath and sanitary installations which has a prefabricated object module that can be mounted so as to be removable. Said module includes the openings for securing means and pipe feed-throughs, suitable for the relevant object, for example wash basin, WC, bidet and other attachment parts. As said object modules have to be produced in each case especially for the object concerned, storage is very costly.

It is the object of the invention to create a mounting device of the aforementioned type making simpler storage and mounting possible, it nevertheless being possible, however, to make available a large selection of different decorative designs with said mounting device.

The object is achieved with a generic mounting device in that the covering has at least one first decorative element concealing the mounting frame at the front and secured to the mounting frame and at least one second decorative element concealing the mounting frame at the top, wherein the second decorative element forms a removable cover for the cistern.

Such a mounting device can be produced in a very cost-efficient manner from comparatively few parts. As the second decorative element is at the same time the removable cover for the cistern, an inspection of the cistern is particularly simple as only this second decorative element has to be removed for such an inspection. The first decorative element can be produced in the form of a plate in various materials and surfaces. In the event of damage, it is possible to remove said decorative element in a non-destructive manner.

According to a further development of the invention, it is provided that the covering has at least two further decorative elements, which conceal the mounting frame at the sides. The mounting frame can then consequently be completely concealed by comparably few parts.

According to a further development of the invention, it is provided that the first decorative element extends substantially over the entire height and width of the mounting frame. Consequently, the decorative design is determined in a definitive manner by said first decorative element. As a rule, it is sufficient for various such first decorative elements to be held in stock. These can be produced, for example, from different materials such as, for example, glass, metal, timber or stone. In addition, they can have different surfaces and, in particular, variously coloured surfaces. Such a decorative element can be exchanged in a particularly simple and non-destructive manner.

According to a further development of the invention, it is provided that the first decorative element has a recess with an upper edge and that it is supported on the mounting frame at said edge. It has been shown that such support is suitable, in particular, for a decorative element made of glass. Only securing means, which press said decorative element against the mounting device, are then necessary. In this way, the first decorative element is secured in a particularly sturdy and secure manner. Nevertheless, said first decorative element can be removed from the mounting frame and then put back again comparatively easily.

The securing of the first decorative element is particularly secure and sturdy when the named edge is supported at a support part secured to the mounting frame. Said support part is preferably produced from plastics material and is preferably secured to a cross bar of the mounting frame. A particularly simple and secure mounting of the decorative element is produced then when, according to a further development of the invention, said decorative element has securing means on its rear side, said securing means being mounted on or snapped onto the mounting frame.

In particular, it is provided that the second decorative element has locking means at the bottom, by means of which locking means it is locked to the mounting frame so as to be liftable. The second decorative element can be placed in position and then removed again substantially without tools. The locking means are in particular downwardly protruding retaining clips that are locked into corresponding securing parts of the mounting frame.

According to a further development of the invention, it is provided that actuating means for initiating a flushing are mounted on the second decorative element. Said actuating means are preferably push buttons which are positioned to the side and at the top are preferably flush with the second decorative element. In principle, however, an embodiment is also conceivable where the second decorative element has other actuating means or the flush is effected in a contact-free manner.

The second decorative element, according to another further development of the invention, is mounted on an upper horizontal strut of the mounting frame. Said horizontal strut has a horizontally extending recess, in which an actuating device is positioned. Said actuating device preferably has a bracket in which actuating levers are mounted. The actuating levers extend through the named horizontal recess of the upper strut. According to a further development of the invention, the first decorative element has a recess in the lower region that is open downwards, through which recess a flush pipe and an outlet pipe extend.

Additional advantageous features are produced from the dependent claims, the following description and the drawing.

Figure 2:
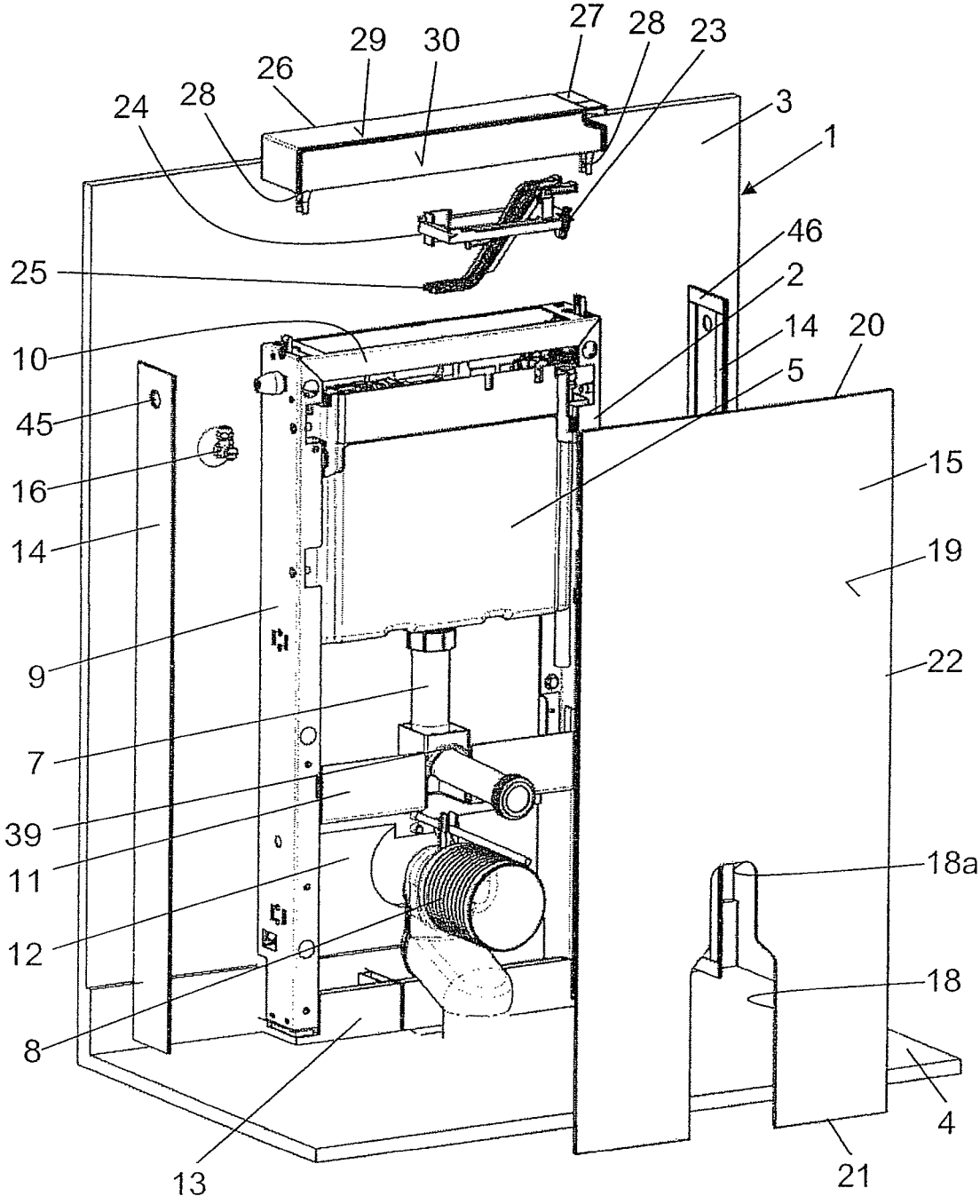
Figure 3:
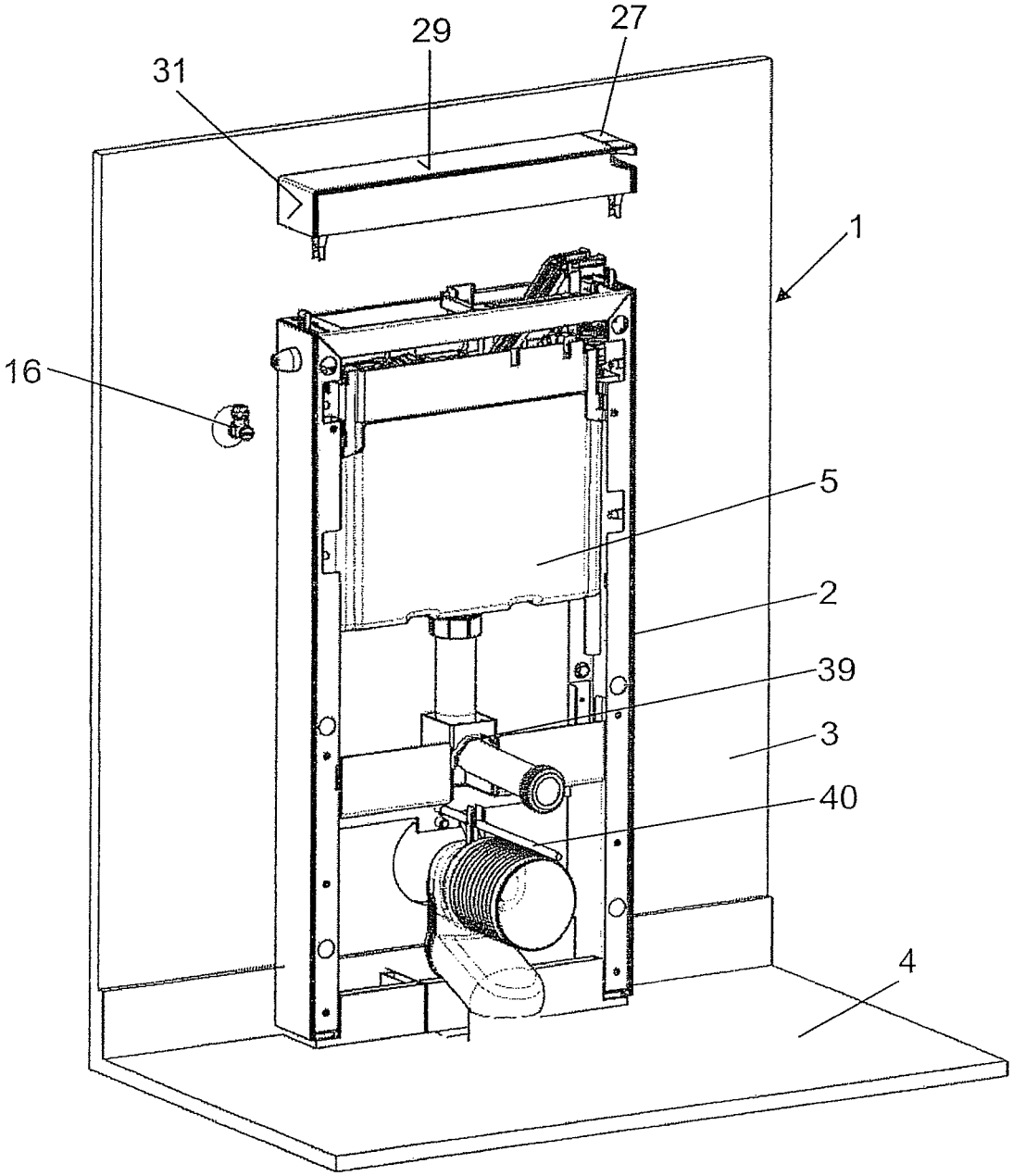
Figure 4:
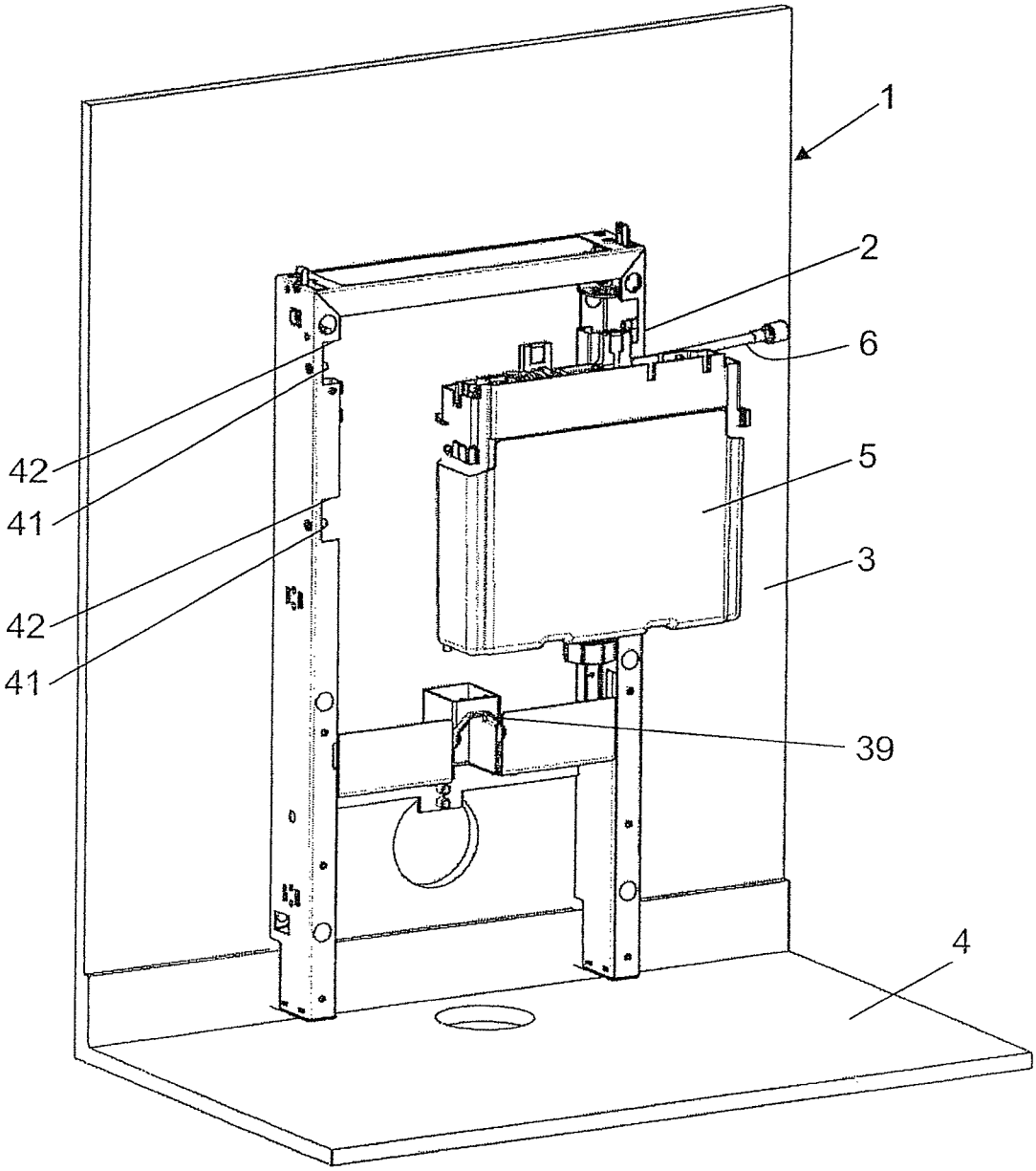
Figure 5:
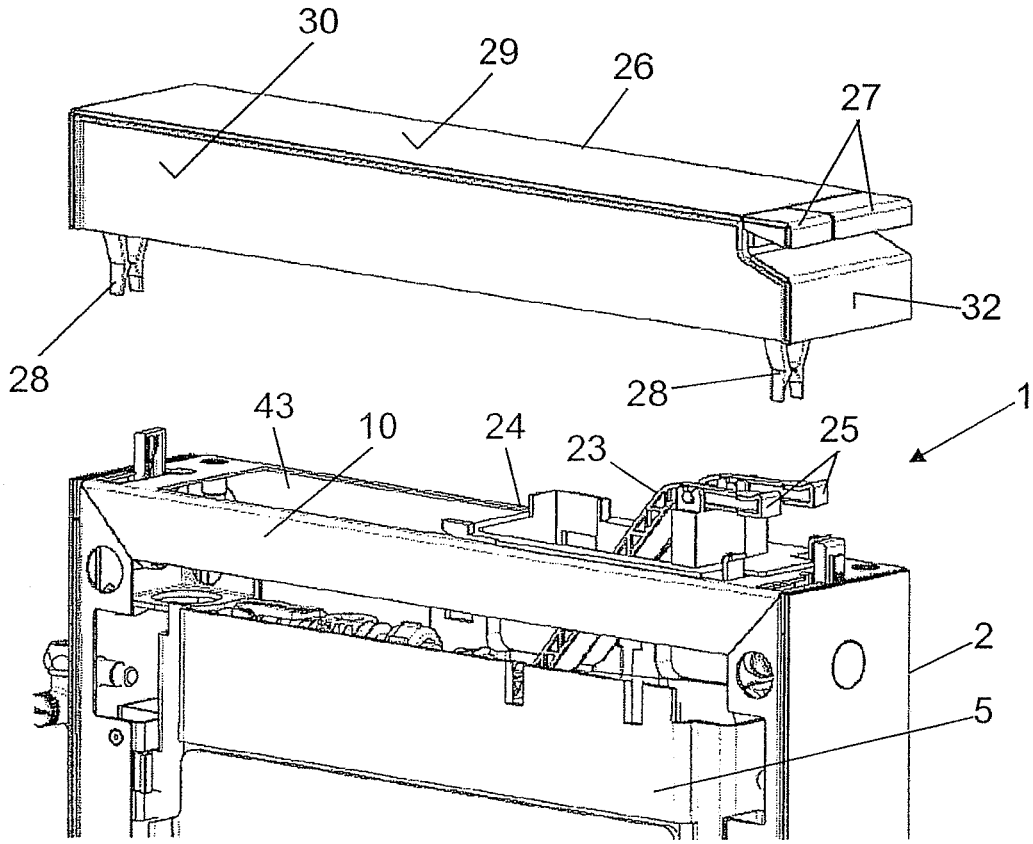
Figure 6:
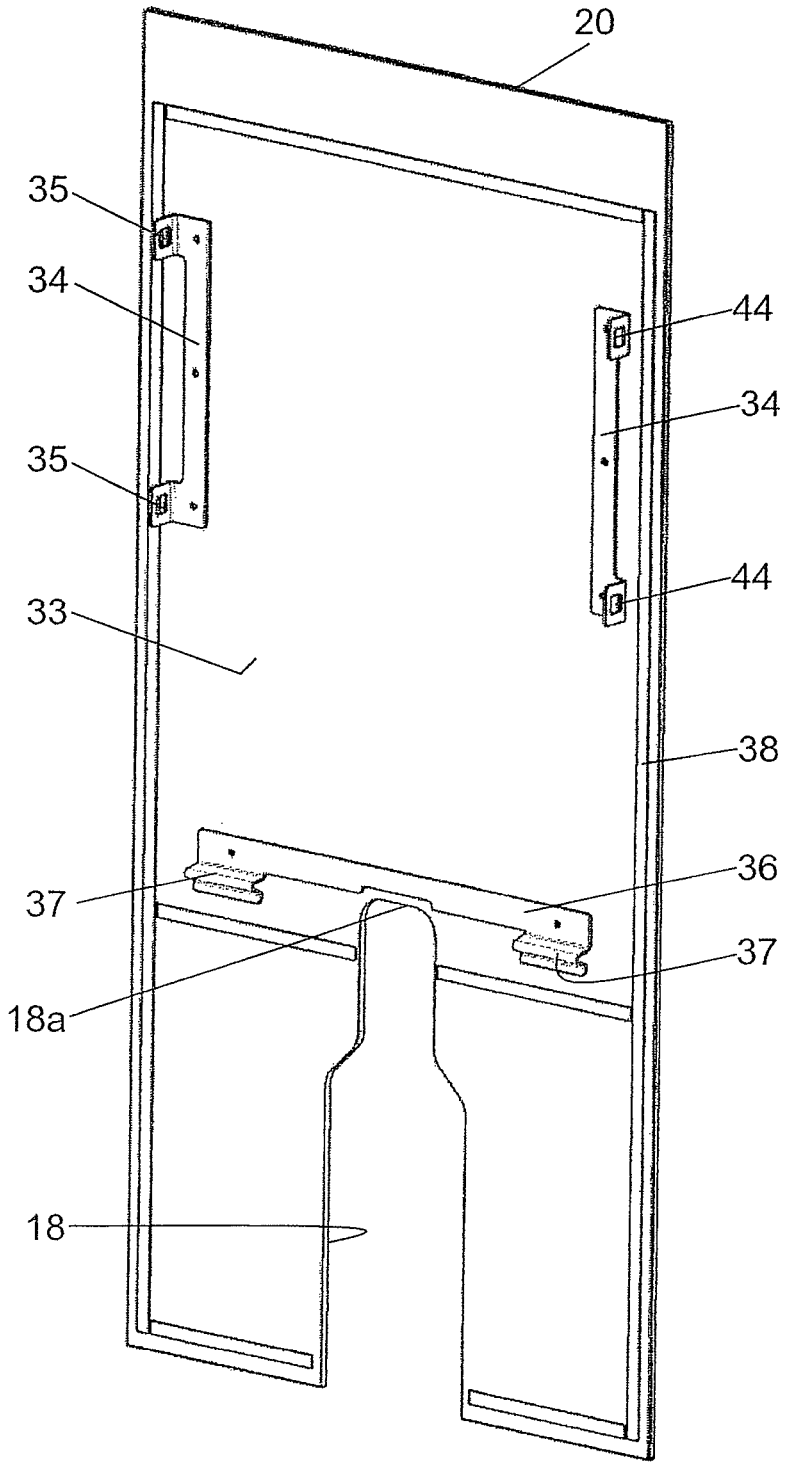

Exemplary embodiments of the invention are given below by way of the drawing, in which, in detail:

FIG. 1 shows a perspective view of the mounting device according to the invention, FIG. 2 shows a view as in FIG. 1, individual parts being shown in an exploded manner for technical reasons, FIG. 3 shows a view as in FIG. 1, the first decorative element having been removed and the second decorative element lifted, FIG. 4 shows another perspective view of the mounting device according to the invention, the decorative elements having been removed and the cistern lifted out of the mounting frame, FIG. 5 shows a perspective view of the upper region of the mounting device according to the invention, but with no first decorative element and FIG. 6 shows a perspective view of the rear side of the first decorative element.

The installation device 1 has a mounting frame 2, which is securable in a known manner to a building wall 3. It can also, however, be mounted free-standing in front of a building wall or free-standing in a room. It has two vertical struts 9 which are positioned spaced apart and are interconnected in each case at an upper end by means of a horizontal strut 10. In a lower region, the two vertical struts 9 are interconnected by a cross bar 11. Said cross bar 11 additionally serves for mounting a flush pipe 7 and a threaded rod 40, on which a waste bend 8 is secured. A sanitary body (not shown here), in particular a toilet bowl, is securable to the mounting frame 2 with two threaded rods that are positioned spaced apart and are secured to the cross bar 11. In addition, a plate 12 is positioned below the cross bar 11 on the mounting frame 2. Finally a base 13 is mounted at the lower end of the mounting frame 2, said base 13 forming a shadow gap 47 and resting on a building floor 4.

A cistern 5 is mounted in the mounting frame 2, the flush pipe 7 being connected to said cistern. The cistern 5 can be designed conventionally and is connected to a water pipe 6 as shown in FIG. 4, said water pipe being connected to an inlet valve (not shown in any more detail here) for introducing the flushing water. Flushing is initiated in a known manner by actuating a discharge fitting (not shown here) mounted in the cistern 5.

A decorative element 26, which forms a cover for the cistern 5, is mounted on the horizontal strut 10. The decorative element 26 has securing elements 28 at the bottom, by means of which securing elements the decorative element 26 is detachably securable to the mounting frame 2. The securing elements 28 are preferably locking means; however other suitable detachable securing means are also conceivable here. For mounting, the decorative element 26 is snapped onto the mounting frame 2. It can be lifted from the mounting frame 2 again without tools. As can be seen, the decorative element 26 extends over the entire width of the mounting frame 2. In the mounted state as shown in FIG. 1, a top side 29 and two side faces 31 and 32 of the decorative element 26 can be seen. The top side 29 forms an upper narrow side and the faces 31 and 32 form parts of lateral narrow sides. As shown in FIG. 5, two push buttons 27 are mounted on the side face 32 on the decorative element 26, said push buttons being substantially flush with the top side 29 and with the side face 32. The push buttons 27 co-operate in each case with a lever 25 for initiating the flush. Said levers 25 form an actuating device 23 together with the bracket 24 shown in FIG. 2. The bracket 24, as shown in FIG. 5, is mounted in a horizontally extending recess 43 of the horizontal strut 10. When the decorative element 26 is lifted from the mounting frame 2, as shown in FIG. 5, the actuating device 23 is accessible from above for inspection. This applies equally to the rest of the fittings positioned in the cistern 5. The decorative element 26 is provided with a decorative material in particular in the region of the top side and the side faces 31 and 32. This can be produced from glass, plastics material, a composite material, timber or stone.

Another decorative element is formed by a front cladding 15, which is plate-shaped and extends preferably over the entire height and width of the mounting frame 2. The front cladding 15 forms a preferably flat front side 19 and a top horizontal edge 20, a bottom edge 21 that is also horizontal and vertically extending side edges 22. The top edge 22 covers a front side 30 of the decorative element 26 and is flush with the top side 29. The side edges 22 are flush with the side faces 31 and 32 in the region of the top edge 20. The height and the width of the front cladding 15 correspond substantially to the height and width of the mounting frame 2. The front cladding 15 is preferably in one piece; however, it could also be assembled from two or more parts.

In a bottom region the front cladding 15 has a recess 18, which is preferably open at the bottom edge 21 as can be seen. Said recess 18 serves for the passage of the flush pipe 7 and of the waste bend 8. At the top end the recess 18 has a horizontally extending edge 18*a*, at which the front cladding 15 is supported by a support part 39. Said support part 39 is preferably produced from plastics material and is secured to the cross bar 11. The support part 39 takes the weight of the front cladding and conducts said weight into the cross bar 11. This mounting arrangement is suitable in particular for a front cladding 15 made of glass.

As shown in FIG. 6, strip-shaped tape 38 made from rubber-resilient sealing material is secured, for example bonded, to the rear side of the front cladding 15. The tape 38 extends in particular vertically and horizontally in the vicinity of the named edges 20, 21 and 22. The tape 38 is positioned such that at the front it abuts against the mounting frame 2. It forms sealing and compensating tape. The front cladding 15 is pressed against the mounting frame 2 over its entire height and width. To this end, securing elements 34 and are mounted on the rear side 33. The securing elements 34 each have inwardly directed lugs 35, which each engage in a recess 42 (FIG. 4) and each have two elongate holes 44, into which bolt-shaped securing parts 41 of the mounting frame 2 engage. The securing element 36 has two lugs 37, which are mounted on the cross bar 11. The securing is, as mentioned, such that the tape 38 is pressed against the mounting frame 2 and consequently connects the front cladding 15 in an extensively sealing manner to the mounting frame 2.

The front cladding 15, as mentioned, is plate-shaped and is produced, for example, from glass, timber, a composite material or stone. However, other materials are also conceivable here, such as plastics material. Once the securing parts 41, which are screw-connectable for example, have been released, the front cladding 15 can be lifted from the mounting frame 2 in a simple and non-destructive manner.

The vertical struts 9 are covered at the sides in each case by a side cladding 14. Said side claddings 14 also form decorative elements that are preferably flush with the front cladding 15 and the decorative element 26. The side claddings 14 extend preferably over the entire height of the vertical struts 9. A recess 45 for receiving a connection part 17 (FIG. 1) is provided in each top region. The inlet valve of the cistern 5 is connected to a corner valve 16 at said connection part 17. As can be seen in FIG. 2, tape 46 is also positioned on the inside of the side claddings 14, said tape fulfilling the same function as the tape 38 already mentioned above. The securing of the side claddings 14 is preferably also effected by means of locking elements (not shown here). The side claddings 14 can consequently also be secured, in particular locked, to the mounting frame 2 so as to be detachable. At the bottom end, the side claddings 14 form the mentioned shadow gap 47 with the base 13 as shown in FIG. 1. This also applies to the front cladding 15.

LIST OF REFERENCES

1 Installation device
2 Mounting frame
3 Building wall
4 Building floor
5 Cistern
6 Water pipe
7 Flush pipe
8 Waste bend
9 Vertical strut
10 Horizontal strut

11 Cross bar
12 Plate
13 Base
14 Side cladding
15 Front cladding
16 Corner valve
17 Connection part
18 Recess
18*a* Bearing edge
19 Front
20 Top edge
21 Bottom edge
22 Side edge
23 Actuating device
24 Bracket
25 Lever
26 Decorative element
27 Push button
28 Securing element
29 Top
30 Front
31 Side face
32 Side face
33 Rear side
34 Securing element
35 Lug
36 Securing element
37 Lug
38 Tape
39 Support part
40 Threaded rod
41 Securing part
42 Recess
43 Recess
44 Elongate hole
45 Recess
46 Tape
47 Shadow gap

The invention claimed is:

1. A mounting device for a sanitary body, said mounting device comprising:

a mounting frame that has a horizontal strut at a top end and that includes means for securing the sanitary body, a cistern mounted on the mounting frame and a covering that conceals the mounting frame at least at the front, wherein said covering has at least one first decorative element concealing the mounting frame at the front and secured to the mounting frame, at least one second decorative element concealing the mounting frame at the top and at least two further decorative elements, said further decorative elements conceal the mounting frame at the sides, extend substantially over the entire height of the mounting frame and are secured to the mounting frame, wherein the second decorative element is designed as a removable cover for the cistern, wherein at least one initiating element for initiating a flush is mounted on the second decorative element, wherein the second decorative element is mounted on said strut and said strut has a horizontally extending recess in which an actuating device for opening and closing an actuation valve is mounted said actuating device, and wherein said at least one first decorative element is non-destructively removable for decorative purposes.

2. The mounting device according to claim 1, wherein said first decorative element extends essentially over an entire height and width of the mounting frame.

3. The mounting device according to claim 1, wherein said first decorative element has a recess with a top edge and in that the first decorative element is supported on the mounting frame at said edge.

4. The mounting device according to claim 3, wherein said edge is supported on a support part secured to the mounting frame.

5. The mounting device according to claim 4, wherein said support part is produced from plastics material and is secured to a cross bar of the mounting frame.

6. The mounting device according to claim 1, wherein said first decorative element has a plurality of edges that define a border region and a tape is fitted at a back side of the first decorative element within said border region, said tape being pressed against the mounting frame and serving as sealing and compensating tape.

7. The mounting device according to claim 1, wherein said first decorative element has securing means on its rear side, said securing means being mounted on or snapped onto the mounting frame.

8. The mounting device according to claim 1, wherein said second decorative element has locking means at a bottom, by means of which locking means the second decorative element is locked to the mounting frame so as to be liftable.

9. The mounting device according to claim 1, wherein said at least one initiating element is a push button.

10. The mounting device according to claim 1, wherein said second decorative element has a top and two side faces, which are visible and flush with the first decorative element.

11. The mounting device according to claim 1, wherein said at least one decorative element is produced from glass or a composite material.

* * * * *